US007765983B2

(12) United States Patent
Eser et al.

(10) Patent No.: US 7,765,983 B2
(45) Date of Patent: Aug. 3, 2010

(54) METHOD AND DEVICE FOR CONTROLLING AN INTERNAL COMBUSTION ENGINE

(75) Inventors: Gerhard Eser, Hemau (DE); Hong Zhang, Tegemheim (DE)

(73) Assignee: Continental Automotive GmbH, Hannover (DE)

( * ) Notice: Subject to any disclaimer, the term of this patent is extended or adjusted under 35 U.S.C. 154(b) by 584 days.

(21) Appl. No.: 11/664,144

(22) PCT Filed: Aug. 10, 2005

(86) PCT No.: PCT/EP2005/053942

§ 371 (c)(1),
(2), (4) Date: Mar. 29, 2007

(87) PCT Pub. No.: WO2006/034916

PCT Pub. Date: Apr. 6, 2006

(65) Prior Publication Data

US 2008/0288159 A1 Nov. 20, 2008

(30) Foreign Application Priority Data

Sep. 30, 2004 (DE) ..... 10 2004 047 622

(51) Int. Cl.
*F02M 37/00* (2006.01)

(52) U.S. Cl. ..... 123/434; 123/472; 123/480; 123/486

(58) Field of Classification Search ..... 123/478, 123/436, 494, 305, 472, 480, 486; 701/104, 701/115, 105, 107, 108, 112, 102
See application file for complete search history.

(56) References Cited

U.S. PATENT DOCUMENTS

| | | | | |
|---|---|---|---|---|
| 6,398,692 | B1 | 6/2002 | Isaac | |
| 6,529,815 | B2 * | 3/2003 | Hawkins et al. | 701/104 |
| 6,748,927 | B2 * | 6/2004 | Joos et al. | 123/478 |
| 2003/0204302 | A1 * | 10/2003 | Amano | 701/102 |

FOREIGN PATENT DOCUMENTS

| | | | |
|---|---|---|---|
| DE | 100 40 251 | A1 | 3/2002 |
| DE | 102 34 706 | A1 | 2/2004 |

* cited by examiner

*Primary Examiner*—Stephen K Cronin
*Assistant Examiner*—Keith Coleman
(74) *Attorney, Agent, or Firm*—King & Spalding L.L.P.

(57) ABSTRACT

An internal combustion engine is provided with at least one modulator for adjusting an air mass in a cylinder. It is also provided with an injection valve for metering fuel to which fuel is supplied via a fuel supply device. A maximum fuel quantity which can be metered to the cylinder per working stroke is determined. Depending on the maximum meterable fuel quantity, a maximum producible torque is determined. An air mass flow is determined depending on an air/fuel ratio to be adjusted and the maximum meterable fuel quantity is adjusted by controlling the at least one modulator for adjusting the air mass. The injection valve is controlled in accordance with the maximum meterable fuel quantity when the required torque is greater or equal the maximum producible torque.

10 Claims, 2 Drawing Sheets

METHOD AND DEVICE FOR CONTROLLING AN INTERNAL COMBUSTION ENGINE

CROSS REFERENCE TO RELATED APPLICATIONS

This application is the US National Stage of International Application No. PCT/EP2005/053942, filed Aug. 10, 2005 and claims the benefit thereof. The International Application claims the benefits of German application No. 10 2004 047 622.5 filed Sep. 30, 2004, both of the applications are incorporated by reference herein in their entirety.

FIELD OF INVENTION

The present invention relates to a method and a device for controlling an internal combustion engine.

BACKGROUND OF THE INVENTION

The performance and efficiency of internal combustion engines are subject to increasingly stringent requirements. Also the pollutant emissions produced by internal combustion engines have to be kept low due to strict legal provisions. To this end final control elements are provided, which allow a very high level of air delivery to be ensured over wide operating areas of the internal combustion engine. Injection valves are also used, to which fuel is supplied at high pressure, and which then meter said fuel into an intake tract or preferably directly into a cylinder of the internal combustion engine. The high fuel pressure means on the one hand that the fuel can be metered in within a very short time. This for example allows operation with a non-homogenous air-fuel mixture in the cylinder, also referred to as layer operation. On the other hand the high pressure of the fuel allows very fine atomization of the fuel particles, which is favorable for the combustion process, in particular in respect of pollutant emissions.

SUMMARY OF INVENTION

The object of the invention is to create a method and device for controlling an internal combustion engine, which respectively allow user-friendly operation of the internal combustion engine.

The object is achieved by the features of the claims. Advantageous embodiments of the invention are characterized in the subclaims.

The invention is characterized by a method and a corresponding device for controlling an internal combustion engine, with at least one final control element for setting an air mass in a cylinder, with an injection valve for metering in fuel, to which fuel is supplied by way of a fuel supply facility. A maximum fuel mass that can be metered into the cylinder per working cycle is determined, when a required torque is greater than or equal to the maximum torque that can be produced. A maximum torque that can be produced is determined as a function of the maximum fuel mass that can be metered in, when a required torque is greater than or equal to the maximum torque that can be produced. An air mass flow to be set is determined as a function of an air/fuel ratio to be set and the maximum fuel mass that can be metered in, when a required torque is greater than or equal to the maximum torque that can be produced. The air mass flow to be set is set by corresponding activation of the at least one final control element for setting the air mass, also when a required torque is greater than or equal to the maximum torque that can be produced. The required torque here refers to a torque that represents the wish of a driver of a motor vehicle, in which the internal combustion engine can be disposed, or even further torque requirements of functions for controlling the internal combustion engine or further units of the vehicle.

It is thus possible to ensure a good drive response of the internal combustion engine, even when there is an error in the fuel supply facility, resulting in a pressure drop in the fuel pressure. Such an error can result in a very significant pressure drop, particularly in the case of a fuel supply facility, which supplies fuel at very high fuel pressure, for example several hundred bar. By setting the air mass flow into the respective cylinder as a function of the maximum fuel mass that can be metered in, it is possible to produce the maximum torque in the respective operating point of the internal combustion engine in the cylinder or cylinders of the internal combustion engine, thereby ensuring a good drive response on the part of the internal combustion engine.

According to an advantageous embodiment of the invention, the maximum fuel mass that can be metered in is determined as a function of a cylinder segment period and a fuel pressure of the fuel, which is supplied to the injection valve. The fuel pressure is determined in a unit for determining the pressure of the fuel. This can be a suitable fuel sensor for example or can even be embodied to determine the fuel pressure as a function of further measured variables, which are detected by sensors of the internal combustion engine.

A cylinder segment period is the time period required for a working cycle, divided by the number of cylinders of the internal combustion engine. In the case of a four-stroke internal combustion engine with four cylinders for example, the cylinder segment period is obtained from the reciprocal value of half the rotational speed divided by the number of cylinders of the internal combustion engine.

It is thus possible to determine the maximum fuel mass that can be metered in particularly simply and by taking the cylinder segment period into account it is also possible in a simple manner to prevent a further pressure drop in the fuel pressure with a high level of probability.

According to a further advantageous embodiment of the invention, the maximum fuel mass that can be metered in is reduced as a function of a gradient of the pressure of the fuel supplied to the injection valve. It is thus possible, if there is an error in the fuel supply facility, to prevent an undesirably large drop in torque in a particularly effective manner, thereby achieving the most constant maximum torque possible.

In a further advantageous embodiment of the invention the at least one final control element is activated to set the air mass in the sense of minimizing a residual gas level in the cylinder, when the required torque is greater than or equal to the maximum torque that can be produced. It is thus possible effectively to prevent the maximum fuel mass to be metered in having to be reduced because the air mass is too small, which would result in a reduction of the torque.

According to a further advantageous embodiment of the invention the method is started, when the fuel pressure is lower by a predetermined threshold value, either absolutely or relative to a fuel pressure to be set, in particular for a predetermined time period. This means that the fuel mass is then only correspondingly limited, when there is an error in the fuel supply facility.

Also the required torque is frequently higher than the maximum torque that can be produced, particularly when there is an error in the fuel supply facility. It is thus still possible to ensure good driveability when subject to the basic conditions of the error.

BRIEF DESCRIPTION OF THE DRAWINGS

Exemplary embodiments of the invention are described in more detail below with reference to the schematic drawings, in which.

DETAILED DESCRIPTION OF INVENTION

Figure 1:
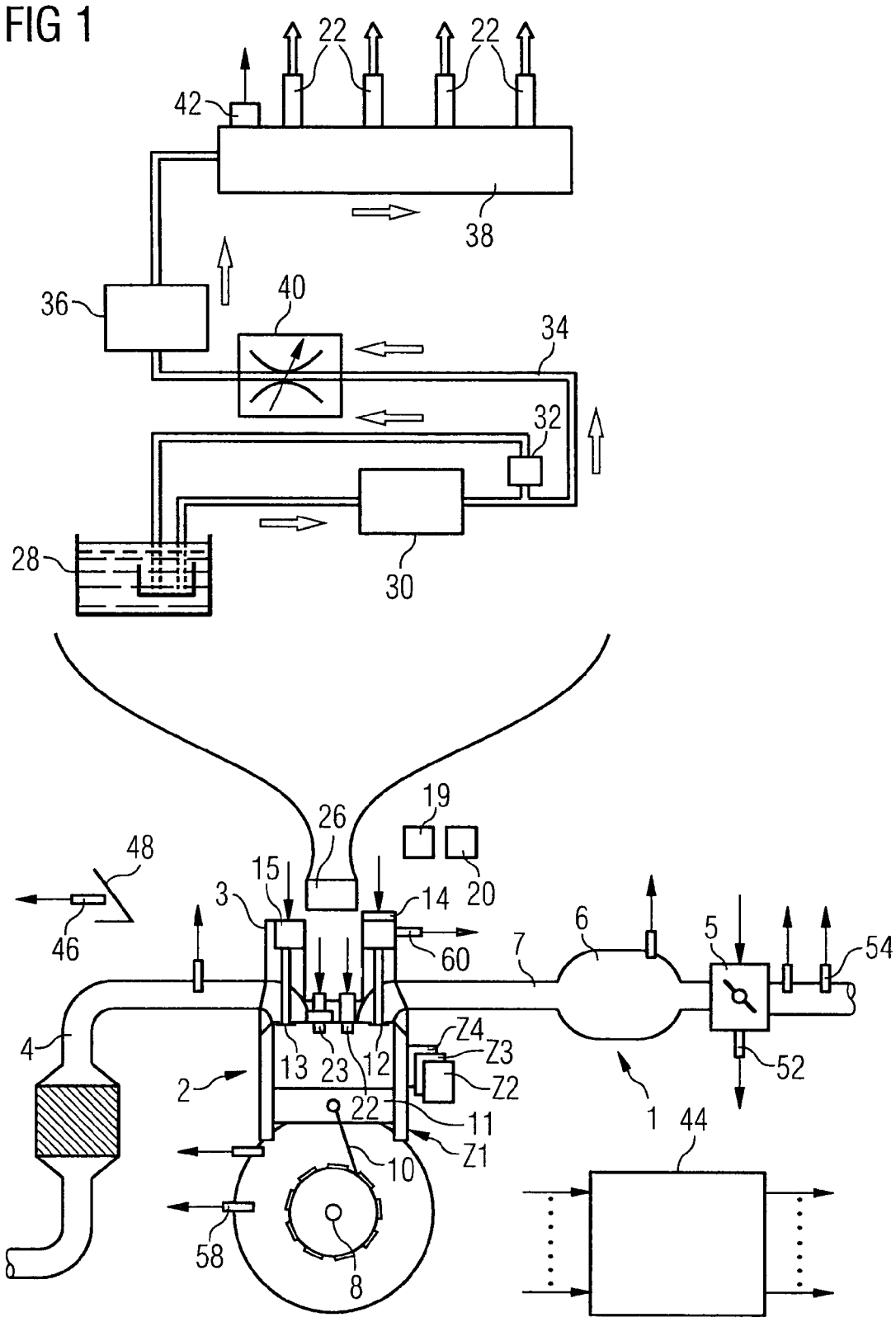
FIG. 1 shows an internal combustion engine with a control device.

An internal combustion engine (FIG. 1) has an intake tract 1, an engine block 2, a cylinder head 3 and an exhaust gas tract 4. The intake tract 1 preferably has a throttle valve 5, also a manifold 6 and an intake pipe 7, which leads to a cylinder Z1 via an intake duct into the engine block 2. The engine block 2 also has a crankshaft 8, which is coupled via a connecting rod 10 to the piston 11 of the cylinder Z1.

The cylinder head 3 has a valve drive with a gas inlet valve 12, a gas outlet valve 13 and valve drives 14, 15. The valve drives 14, 15 have or are assigned a camshaft, having cams, which act on the gas inlet valve 12 and/or the gas outlet valve 13. A separate camshaft is preferably assigned respectively to the gas inlet valve 12 and the gas outlet valve 13.

A valve lift adjustment device 19 can also be provided, to change the lift pattern, allowing a low and high valve lift to be set for example. A phase adjustment device 20 can also be provided, by means of which a phase angle of the respective camshaft can be adjusted. Phase angle refers to an angle, for example the crankshaft angle between two reference marks, one on the crankshaft and the other on the respective camshaft, in relation in each instance to an absolute position either of the crankshaft or the camshaft.

By varying the phase angle it possible optionally to set a valve overlap, in other words a region, in which both the gas inlet valve 12 and the gas outlet valve 13 release the inlet or, respectively, outlet.

The gas inlet valve 12, the valve lift adjustment device 19 and the phase adjustment device 20 form final control elements to set an air mass in the respective cylinder Z1. Further such final control elements can be provided and are for example formed by the throttle valve 5, a switching valve in the intake pipe or manifold, a pulse charging valve or even a turbocharger.

The cylinder head 3 also has an injection valve, which is disposed in such a manner that it can meter fuel into a combustion chamber of the cylinder 1. Alternatively however the injection valve 23 can also be disposed in the intake pipe 7. The cylinder also preferably has a spark plug 23.

The internal combustion engine also has a fuel supply facility 26. The fuel supply facility 26 has a fuel tank 28, connected by way of a first fuel line to a low-pressure pump 30. On the output side the low-pressure pump 30 is connected to an intake 34 of a high-pressure pump 36. A mechanical regulator 32 is also provided on the output side of the low-pressure pump 30, being connected on the output side to the fuel tank 28 by way of a further fuel line. The low-pressure pump 30, the mechanical regulator 32, the fuel line, the further fuel line and the intake 34 form a low-pressure circuit.

The low-pressure pump 30 is preferably designed such that it always supplies a sufficiently large quantity of fuel during operation of the internal combustion engine, ensuring that there is no drop to below a predetermined low pressure.

The high-pressure pump is configured such that it delivers the fuel to a fuel storage unit 38 on the output side. The high-pressure pump 36 is generally coupled to the camshaft on the drive side and is thus driven by said camshaft and delivers a constant volume of fuel into the fuel storage unit 38 at a constant rotational speed N of the crankshaft 8.

The injection valves 22 are connected to the fuel storage unit 38. The fuel is thus supplied to the injection valves 22 by way of the fuel storage unit 38.

Before or upstream of the high-pressure pump 36 a volume flow control valve 40 is provided, which can be used to set the volume flow supplied to the high-pressure pump 36. It is possible to ensure, by corresponding activation of the volume flow control valve 40, that the required fuel pressure prevails in the fuel storage unit, without an electromagnetic regulator having to be provided on the output side of the fuel storage unit 38 with a corresponding feedback line into the low-pressure circuit.

Alternatively however the internal combustion engine can also be provided with an electromagnetic regulator on the output side of the fuel storage unit 38 and with a corresponding feedback line into the low-pressure circuit. Alternatively it is also possible for the volume flow control valve 40 to be integrated in the high-pressure pump 54.

A control device 44 is provided, to which sensors are assigned, which detect different measured variables and determine the value of the measured variable in each instance. The control device 44 determines manipulated variables as a function of at least one measured variable, said manipulated variables then being converted to one or more actuating signals to control the final control elements by means of corresponding actuators. The control device 44 can also be referred to as a device for controlling the internal combustion engine. It has a data and program storage unit and a computation unit, in which programs for controlling the internal combustion engine are processed during operation of the internal combustion engine.

The sensors are a pedal position sensor 46, which detects the position of an accelerator pedal 48, a throttle valve position sensor 52, which detects an opening angle of the throttle valve 5, a temperature sensor 54, which detects an intake air temperature, a crankshaft angle sensor 58, which detects a crankshaft angle, to which a rotational speed N is then assigned. A camshaft angle sensor 58 is also preferably provided, which detects a camshaft angle. If there are two camshafts present, a specific camshaft angle sensor is preferably assigned to each camshaft. An exhaust gas probe 62 is also provided, which detects a residual oxygen content of the exhaust gas and the measurement signal of which is characteristic of the air/fuel ratio in the cylinder Z1. A fuel pressure sensor 42 is also provided, which is used to determine a fuel pressure FUP/AV in the fuel storage unit 38.

Any sub-set of the said sensors or even additional sensors can be present, depending on the embodiment of the invention.

Final control elements of the internal combustion engine are for example the throttle valve 5, the gas inlet and gas outlet valves 12, 13, the valve lift adjustment device 19, the phase adjustment device 20, the injection valve 22 or the spark plug 23.

As well as the cylinder Z1, further cylinders Z2-Z4 are also preferably provided, to which corresponding final control elements and optionally corresponding sensors are similarly assigned.

Figure 2:
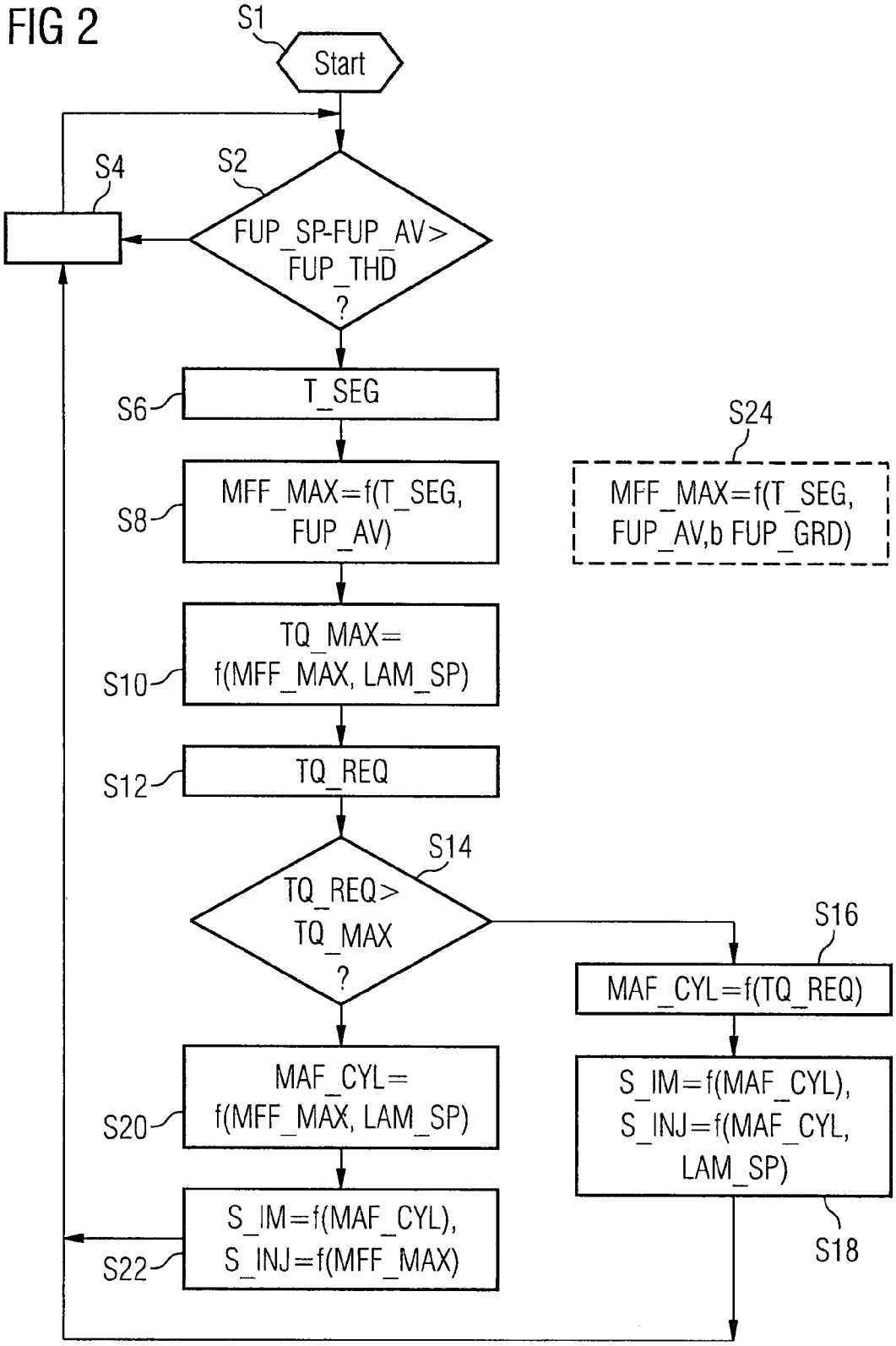
FIG. 2 shows a flow diagram of a program for controlling an internal combustion engine.

A program for controlling the internal combustion engine is stored in the program storage unit of the control device 44 and can be processed during operation of the internal combustion engine. The program is started in a step S1 (FIG. 2), in which variables are optionally initialized. The start preferably takes place at a time near to the time when the motor is started.

In a step S2 it is verified whether a difference between a fuel pressure to be set FUP_SP and a determined fuel pressure FUP_AV is greater than a threshold value FUP_THD, which is predetermined in an appropriate manner. The threshold value FUP_THD is preferably predetermined such that it is representative of a fuel pressure drop indicating an error in the fuel supply facility 26. It is thus preferably predetermined as a function of a delivery volume of the high-pressure pump and/or a fuel temperature and/or the rotational speed. Alternatively in step S2 a quotient of the fuel pressure to be set FUP_SP and a quotient of the determined fuel pressure FUP_AV can be calculated and compared with the threshold value FUP_THD. Alternatively it can also be verified in step S2 whether an integral of the difference between the fuel pressure to be set FUP_SP and the determined fuel pressure FUP_AV is greater than the threshold value FUP_THD, which is then similarly predetermined in an appropriate manner. It can also be verified in step S2 whether the determined fuel pressure FUP_AV is below a further threshold value.

If the condition of step S2 is not satisfied, processing is continued in a step S4, in which the program is preferably interrupted for a predetermined waiting period or a predetermined crankshaft angle, before processing is resumed in step S2. If however the condition of step S2 is satisfied, processing is continued in a step S6. In an alternative embodiment of the program step S2 can be dispensed with and processing can be continued directly in step S6.

A cylinder segment period T_SEG is determined in step S6. The cylinder segment period can be determined simply as a function of the rotational speed N and the number of cylinders Z1-Z4. In the case of a two-stroke internal combustion engine with four cylinders, it can be determined from a quotient of a reciprocal value of half the rotational speed N and the number of cylinders.

In a subsequent step S8 a maximum fuel mass MFF_MAX that can be metered into the respective cylinder Z1-Z4 per working cycle is calculated as a function of the cylinder segment period T_SEG and the determined fuel pressure FUP_AV. This can be done for example by means of a previously determined set of characteristics or even by means of an analytical relationship. The link between the maximum fuel mass MFF_MAX that can be metered in and the cylinder segment period T_SEG and the determined fuel pressure FUP_AV is preferably determined beforehand by tests on an engine test bed or even by simulations.

It can be ensured by means of the dependency on the cylinder segment period T_SEG that a maximum period required to meter in the maximum fuel mass MFF_MAX that can be metered in does not in any case exceed the cylinder segment period T_SEG. It is thus possible in a simple manner to reduce significantly the probability of the fuel pressure, in other words the determined fuel pressure FUP_AV, dropping in an undesirable manner.

In a step S10 a maximum torque TQ_MAX that can be produced is then determined as a function of the maximum fuel mass MFF_MAX that can be metered in and an air/fuel radio LAM_SP to be set. The air fuel ratio to be set can for example be predetermined in a fixed manner but is preferably determined by a function for controlling the internal combustion engine or by a further function for controlling the internal combustion engine during operation of the internal combustion engine. Alternatively, when determining the maximum torque that can be produced, it is also possible to take into account a value of a manipulated variable of a lambda controller that is optionally present. It is also possible to take further influencing variables into account in this process.

In a step S12 a required torque TQ_REQ is then read in, which is determined in a further function of the internal combustion engine, preferably for example as a function of the position of the accelerator pedal 48 and optionally further torque requirements, for example from units, such as a transmission.

In a step S14 it is verified whether the required torque TQ_REQ is greater than the maximum torque TQ_MAX that can be produced.

If this is not the case, in a step S16 an air mass flow MAF_CYL to be set in the respective cylinder Z1-Z4 is determined as a function of the required torque TQ_REQ. The air mass flow MAF_CYL to be set in the respective cylinder corresponds to the air mass flowing into the respective cylinder Z1-Z4 per working cycle.

In a step S18 an actuating signal S_IM is determined for at least one of the final control elements for setting the air mass, as a function of the air mass flow MAF_CYL to be set. Also in step S18 an actuating signal S_INJ for activating the injection valve 22 is determined, as a function of the air mass flow MAF_CYL into the cylinder to be set and the air/fuel ratio LAM_SP in the cylinder to be set, optionally taking into account the value of the manipulated variable of the lambda controller.

Processing is then continued in step S4.

If however the condition of step S14 is satisfied, in a step S20 the air mass flow MAF_CYL to be set is determined as a function of the maximum fuel mass MAF_MAX that can be metered into the respective cylinder Z1-Z4 per working cycle and the air/fuel ratio to be set.

In a step S22 at least one actuating signal S_IM for the at least one final control element for setting the air mass is determined as a function of the air mass flow MAF_CYL to be set. In this context the determination of the actuating signal(s) S_IM for the final control elements for setting the air mass preferably takes place in such a manner that the residual gas level in the cylinder before combustion of the air/fuel mixture is minimized, in order to be able to ensure that the highest possible torque is produced. The actuating signal S_INJ for activating the injection valve 22 is also determined, as a function of the maximum fuel mass MFF_MAX that can be metered into the cylinder per working cycle. The program is then continued in step S4.

It is particularly advantageous if, as an alternative to step S8, a step 24 is carried out, in which the maximum fuel mass MFF_MAX that can be metered in is determined as a function of the cylinder segment period T_SEG, the determined pressure FUP_AV and also as a function of a gradient FUP_GRD of the fuel pressure. It is thus possible to prevent a further undesirable pressure drop in the fuel pressure in a simple manner.

The invention claimed is:

1. A method for controlling an internal combustion engine having a plurality of cylinders, a final control element for setting an air mass into one of the cylinders of the engine and an injection valve for metering in fuel connected to a fuel supply facility, comprising:

determining a maximum fuel mass to be metered into one of the plurality of cylinders per working cycle, wherein the maximum fuel mass to be metered in is determined as a function of a cylinder segment period and a fuel pressure supplied to the injection valve;

determining a maximum torque producible as a function of the maximum fuel mass to be metered in;

determining an air mass flow to be set as a function of an air/fuel ratio to be set and the maximum fuel mass to be metered in;

activating a final control element for setting the determined air mass flow; and activating the injection valve when a required torque is greater than or equal to the maximum producible torque.

2. The method as claimed in claim 1, wherein the fuel pressure is determined in a unit for determining the pressure of the fuel.

3. The method as claimed in claim 1, wherein the maximum fuel mass to be metered in is reduced as a function of a fuel pressure gradient.

4. The method as claimed in claim 3, wherein the final control element is activated to set the air mass to minimize a residual gas level in one of the plurality of cylinders, when the required torque is greater than or equal to the maximum producible torque.

5. The method as claimed claim 4, wherein the method is started when the fuel pressure is less than a predetermined threshold value either absolutely or relatively to the fuel pressure to be set.

6. A method for controlling an internal combustion engine having a plurality of cylinders, a final control element for setting an air mass into one of the cylinders of the engine and an injection valve for metering in fuel connected to a fuel supply facility, comprising:

determining a maximum fuel mass to be metered into one of the plurality of cylinders per working cycle;

determining a maximum torque producible as a function of the maximum fuel mass to be metered in;

determining an air mass flow to be set as a function of an air/fuel ratio to be set and the maximum fuel mass to be metered in;

activating a final control element for setting the determined air mass flow; and activating the injection valve when a required torque is greater than or equal to the maximum producible torque, wherein the maximum fuel mass to be metered in is determined as a function of a time period required fora working cycle of the engine divided by the number of cylinders of the engine and a fuel pressure supplied to the injection valve, where the fuel pressure is determined in a unit for determining the pressure of the fuel, wherein the maximum fuel mass to be metered in is reduced as a function of a fuel pressure gradient, wherein the final control element is activated to set the air mass to minimize a residual gas level in one of the plurality of cylinders, when the required torque is greater than or equal to the maximum producible torque, and wherein the method is started when the fuel pressure is less than a predetermined threshold value either absolutely or relatively to the fuel pressure to be net.

7. A device for controlling an internal combustion engine having a final control element for setting an air mass into a cylinder of the engine, an injection valve for metering in fuel to the cylinder, and the injection valve connected to a fuel supply facility that supplies fuel to the injection valve, comprising:

a maximum fuel mass determining device that determines a maximum fuel mass to be metered into the cylinder per working cycle as a function of a cylinder segment period and a fuel pressure supplied to the injection valve;

a maximum torque determining device that determines a maximum torque producible as a function of the maximum fuel mass to be metered in;

an air mass flow determining device that determines an air mass flow to be set as a function of an air/fuel ratio to be set and the maximum fuel mass to be metered in, wherein the control device:

activates the final control element for setting the determined air mass flow, and activates the injection valve when a required torque is greater than or equal to the maximum producible torque.

8. The device as claimed in claim 7, wherein the maximum fuel mass to be metered in is determined as a function of a cylinder segment period and a fuel pressure supplied to the injection valve, where the fuel pressure is determined in a unit for determining the pressure of the fuel.

9. The device as claimed in claim 8, wherein the maximum fuel mass to be metered in is reduced as a function of a fuel pressure gradient.

10. The device as claimed in claim 9, wherein the final control element is activated to set the air mass to minimize a residual gas level in one of the plurality of cylinders, when the required torque is greater than or equal to the maximum producible torque.

* * * * *